US010876258B2

(12) United States Patent
Aittamaa

(10) Patent No.: US 10,876,258 B2
(45) Date of Patent: Dec. 29, 2020

(54) METHOD FOR IMPROVING FILLER AND FIBER RETENTION IN PAPER MAKING PROCESSES

(71) Applicant: SOLENIS TECHNOLOGIES, L.P., Wilmington, DE (US)

(72) Inventor: Teemu Aittamaa, Jokioinen (FI)

(73) Assignee: SOLENIS TECHNOLOGIES, L.P., Wilmington, DE (US)

( * ) Notice: Subject to any disclaimer, the term of this patent is extended or adjusted under 35 U.S.C. 154(b) by 61 days.

(21) Appl. No.: 16/200,954

(22) Filed: Nov. 27, 2018

(65) Prior Publication Data

US 2020/0165779 A1 May 28, 2020

(51) Int. Cl.

| | |
|---|---|
| ***D21H 23/20*** | (2006.01) |
| ***D21H 17/67*** | (2006.01) |
| ***D21J 1/00*** | (2006.01) |

(52) U.S. Cl.

CPC ..... *D21H 23/20* (2013.01); *D21H 17/675* (2013.01); *D21J 1/00* (2013.01)

(58) Field of Classification Search

USPC ..... 162/181.5

See application file for complete search history.

(56) References Cited

U.S. PATENT DOCUMENTS

| | | | |
|---|---|---|---|
| 4,889,594 | A | 12/1989 | Gavelin |
| 5,286,326 | A | 2/1994 | Greve |
| 5,576,358 | A | 11/1996 | Lem et al. |
| 5,876,564 | A | 3/1999 | Aidun |
| 6,361,653 | B2 | 3/2002 | Keiser et al. |
| 9,028,767 | B2 | 5/2015 | Rasanen et al. |

FOREIGN PATENT DOCUMENTS

| | | | |
|---|---|---|---|
| CN | 103628349 | A | 3/2014 |
| CN | 105568775 | A | 5/2016 |
| EP | 2767634 | A1 | 8/2014 |
| JP | 2002173890 | A | 6/2002 |
| KR | 20120073969 | A | 7/2012 |
| KR | 20160103894 | A | 9/2016 |
| WO | 9308329 | A1 | 4/1993 |
| WO | 2011110744 | A2 | 9/2011 |

OTHER PUBLICATIONS

ISA/US, International Search Report and Written Opinion issued in Int. Appl. No. PCT/US2019/062727 dated Jan. 28, 2020.

*Primary Examiner* — Mark Halpern

(74) *Attorney, Agent, or Firm* — Lorenz & Kopf, LLP

(57) ABSTRACT

A process and device for improving filler retention of paper, paperboard, or cardboard. The process provides for an electromagnetic force being applied to a filler material and/or cellulosic furnish, thereby changing the surface charge of the filler material and/or cellulosic furnish and forming a paper, paperboard, or cardboard product.

14 Claims, 4 Drawing Sheets

METHOD FOR IMPROVING FILLER AND FIBER RETENTION IN PAPER MAKING PROCESSES

TECHNICAL FIELD

The present disclosure pertains to the manufacture of paper and paper products in which various fillers are used.

BACKGROUND

Most paper manufacturing processes incorporate various fillers in making paper products to improve various properties of the final product. Fillers that are dominantly applied in the paper mill are mostly minerals. While there are various reasons why fillers are used in papermaking, the lower cost of filler relative fiber is the most commercially important reason\. The application of fillers also increased brightness, opacity, productivity, improve printability (smoothness, ink absorption, show through), gloss of paper, sheet formation (fill in void), dimensional stability, paper's appearance, etc. In addition, filler increases water drainage and drying rate of the formed sheets.

However, most fillers are unable to attach to the cellulosic fibers because of the highly diluted system, the small particle size of the fillers, and the surface charge of the fillers are weak or do not bond well with cellulosic fibers. Because the filler materials are relatively small, generally on the order of from about 0.1 micron (μm) to about 1 μm, and their surface charge is weak, typically from 0 millivolts (mV) to minus 400 mV, it can be difficult for the fillers to firmly attach themselves to the cellulosic fibers in the papermaking process thereby resulting in poor filler retention, poor wet and dry strength of the paper and poor printability. Therefore, cationic or anionic polymers are used to help improve the retention of the filler particles to the cellulosic fiber, for example, in the pulp and paper industry.

Papermaking systems are also low consistency water systems, generally including of about 96 wt. % to 99.9 wt. % water. This largely contributes to the poor retention of the filler particles, which if not retained in the final product, goes out with the wastewater. Therefore, excess filler material needs to be added to the system in order to obtain the desired filler levels, resulting in lost revenues.

Cellulosic fibers are anionic in nature as are most filler materials. Therefore, cationic polymers are generally used to attach the filler material to the cellulosic fibers. This increases the area of the filler by making large polymer chains, which can more easily attach to the cellulosic fiber. However, there is still a large amount of filler that are left in the water systems because the fillers do not meet the attaching polymer chain in the low consistency water system. In other words, when surface charge is changed in low consistency water systems via polymers, the surface charge of a significant portion of the fillers will remain unchanged and thus will not be attracted to the fiber.

Poor filler retention continues to be an issue in the pulp and paper industry and chemicals only solve part of the problem. Therefore, there is still a need in the papermaking process to find a consistent method for the retention of fillers, without creating issues such as scaling, poor sheet formation, etc.

SUMMARY

A process is provided for producing an improved filled paper product. In particular, the process provides for an improved paper, paperboard, or cardboard wherein a cellulosic furnish and a filler material is provided. An electromagnetic force or charge is applied to the filler material, thereby altering or changing the surface charge of the filler material. The electromagnetic force or charge is applied to the filler material until the surface charge of the filler material is changed producing a "treated" filler material. The treated filler material is then combined with the cellulosic furnish and a paper, paperboard or cardboard product is produced.

In addition, a device for improving filler retention in a papermaking process is provided for. The device includes a treatment zone configured to receive one or more filler materials and/or a cellulosic furnish. The treatment zone includes a magnetic device disposed relative to the treatment zone and configured to generate an electromagnetic force within the treatment zone. The magnetic device is further configured to apply the electromagnetic force to one or more filler materials and/or the cellulosic furnish in an amount sufficient to change the surface charge of the one or more filler materials and/or the cellulosic furnish as the one or more filler materials and/or the cellulosic furnish moves through the treatment zone. After the filler material and/or cellulosic furnish passes through the treatment zone the desired amount or length of time necessary to affect the filler materials initial charge, a paper, paperboard, or cardboard product can be made with improved filler retention.

Finally, provided is a cellulosic product produced by the process wherein an electromagnetic force or charge is applied to a filler material, which is then combined with the cellulosic furnish and a paper, paperboard or cardboard product is produced.

BRIEF DESCRIPTION OF THE DRAWINGS

The present invention will hereinafter be described in conjunction with the following drawing figures, wherein like numerals denote like elements.

DETAILED DESCRIPTION

Figure 1:
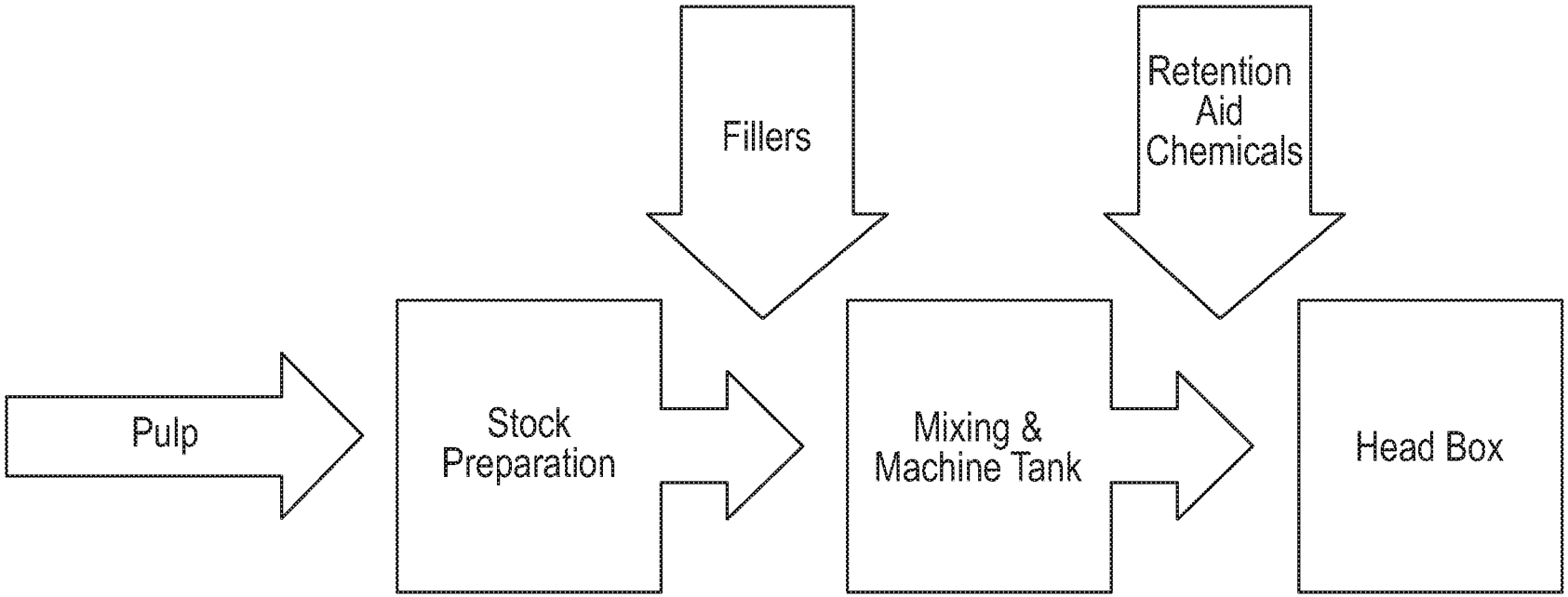
FIG. 1, shows a schematic of a typical papermaking process.

The following detailed description is merely exemplary in nature and is not intended to limit the invention or the application and uses of the invention. Furthermore, there is no intention to be bound by any theory presented in the preceding background of the invention or the following detailed description.

The current invention provides for a device and a process, which provides for the improved production of a filled paper, paperboard, or cardboard. The process involves providing a cellulosic furnish and combining the cellulosic furnish with one or more filler materials. In a preferred aspect of the current method, an electromagnetic force (EMF) or charge is applied to the filler material prior to the filler material being combined with the cellulosic furnish. However, it is envisioned that the filler material can be combined with the cellulosic furnish and an electromagnetic charge applied thereto.

In one aspect of the current process, a filler material is transferred from a transport vehicle or storage vessel to a cellulosic furnish, such as a papermaking furnish. The transfer of filler material to the cellulosic material can be accomplished using a conveyance system, such as, a transfer vessel, a conduit, hosing, piping or other similar method. Prior to the filler material being combined with the cellulosic material, the filler material passes through a magnetic device disposed within the conveyance system and is capable of imparting an electromagnetic force or charge on the filler material sufficient to change the surface charge of the filler material producing a treated filler material, which is then combined with the cellulosic furnish.

In one aspect of the current process, one or more filler materials are transferred from a truck or storage vessel to a filler material transfer vessel and combined with a cellulosic furnish, such as a pulp and paper furnish. Disposed within the transfer vessel is a magnetic device having a treatment zone where an electromagnetic force or charge can be applied to the filler material such that the surface charge of the filler material is changed. The "treated" filler material is then combined with the cellulosic furnish and a paper product formed.

In other aspects of the current process, the filler material is transferred to a filler material transfer vessel capable of circulating or recirculating the contents of the filler material in the transfer vessel. A magnetic device having a treatment zone is disposed within the transfer vessel. The filler material is moved through the treatment zone where an electromagnetic force (EMF) or charge is applied to the filler material thus changing the surface charge of the filler material. A circulating pump or similar device can be used to circulate the filler material through a closed-loop system so that the EMF can be applied to the filler material one or more times if desired. The power of the EMF can be pre-set or can be configured wherein the power can be adjusted, for example, using the 475 DSP Gaussmeter, by Lake Shore Cryotronics, Inc.

After the EMF has been applied to the filler material one or more times, the filler material can be combined with a cellulosic furnish, such as a pulp and paper furnish.

Referring to FIG. 1, the treated filler material, i.e. the filler material that has been subjected to an EMF, is added to the cellulosic furnish just prior to or at the mixing and machine chest. However, the treated filler material can be added prior to or at the stock preparation, prior to or at the head box, or the treated filler could be added at multiple points prior to formation of the cellulosic product.

Figure 2:
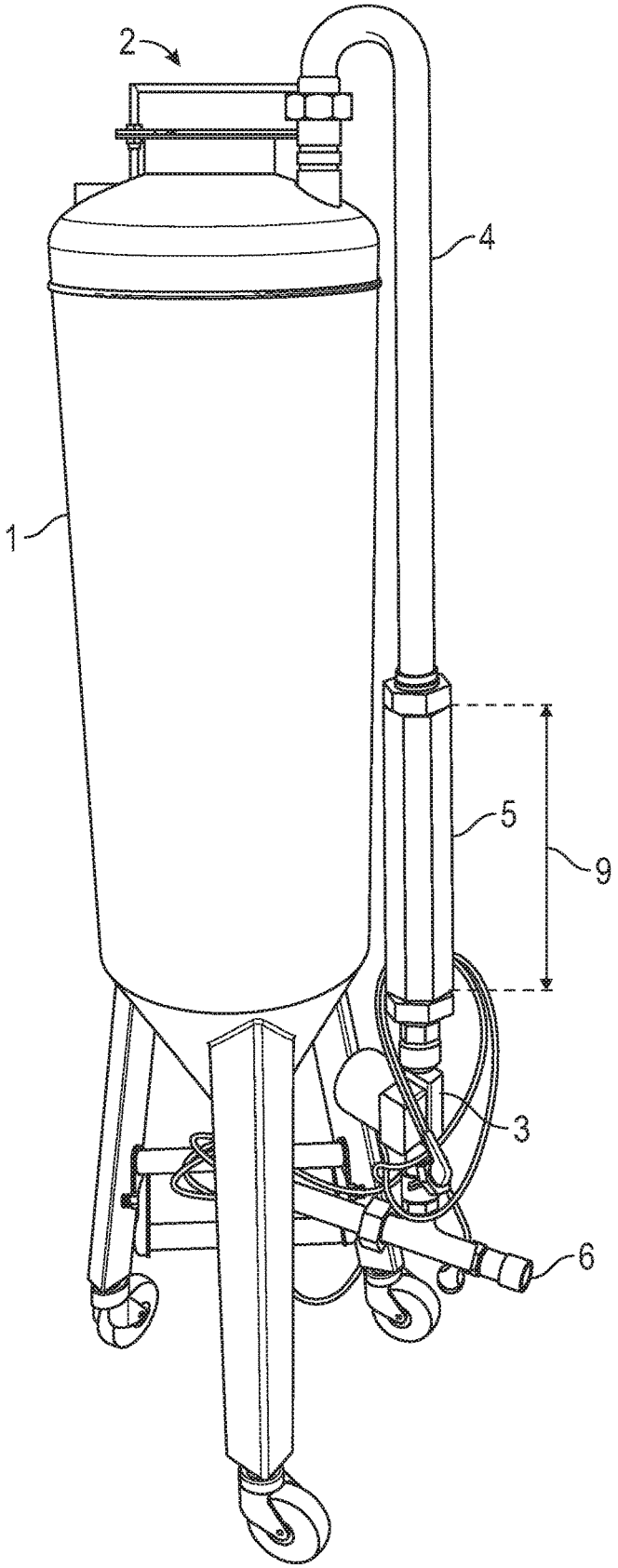
FIG. 2, is a perspective view illustrating an embodiment of a transfer vessel.

In one aspect of the device, referring to FIG. 2, there is a transfer vessel (1) in which a filler material and/or a cellulosic furnish can be stored, treated with an electromagnetic charge and if only filler material is in the transfer vessel, the filler material is transferred to be combined with a cellulosic furnish. Otherwise, the combined filler material and cellulosic furnish can be sent to a paper machine for production of the desired product. The filler material is transferred from a storage vehicle or vessel to the transfer vessel (1). The transfer vessel (1) has an inlet (2) or opening in which the filler material can be transferred into or through transfer vessel (1). In a preferred aspect, a filler material is transferred into the transfer vessel through inlet (2) and after the desired amount of filler material is transferred into the transfer vessel (1), the inlet (2) can be closed or shut and the filler material circulated through the transfer vessel (1) in a closed-loop system including the transfer vessel (1), circulating device (3), a magnetic device (5), and a return pipe or conduit (4). The transfer vessel (1) can be equipped with a pump or circulating device (3) that circulates the filler material through the closed-loop system (1), (3), (4) and (5). A magnetic device (5) having a treatment zone (9) capable of applying an electromagnetic force or charge to the filler material is disposed within the closed loop system, (1), (3), (4) and (5) in which the filler material is circulated. A pump or circulating device (3) is shown as being prior to the magnetic device (5). However, it could be located after the magnetic device (5) or anywhere in the closed-loop system (1), (3), (4) and (5) that the filler material can pass through the magnetic device and an electromagnetic force or charge can be applied to the filler material. The filler material can be circulated through the treatment zone (9) of the closed-loop system (1), (3), (4) and (5) and the electromagnetic force or charge can be applied to the filler material one or more times. After the filler material has been sufficiently treated, i.e. the surface charge of the filler material has been changed, the outlet (6) of the transfer vessel (1) is opened and the treated filler material is combined with the cellulosic furnish as necessary to form a paper, paperboard, or cardboard product having improved filler retention.

Figure 3:
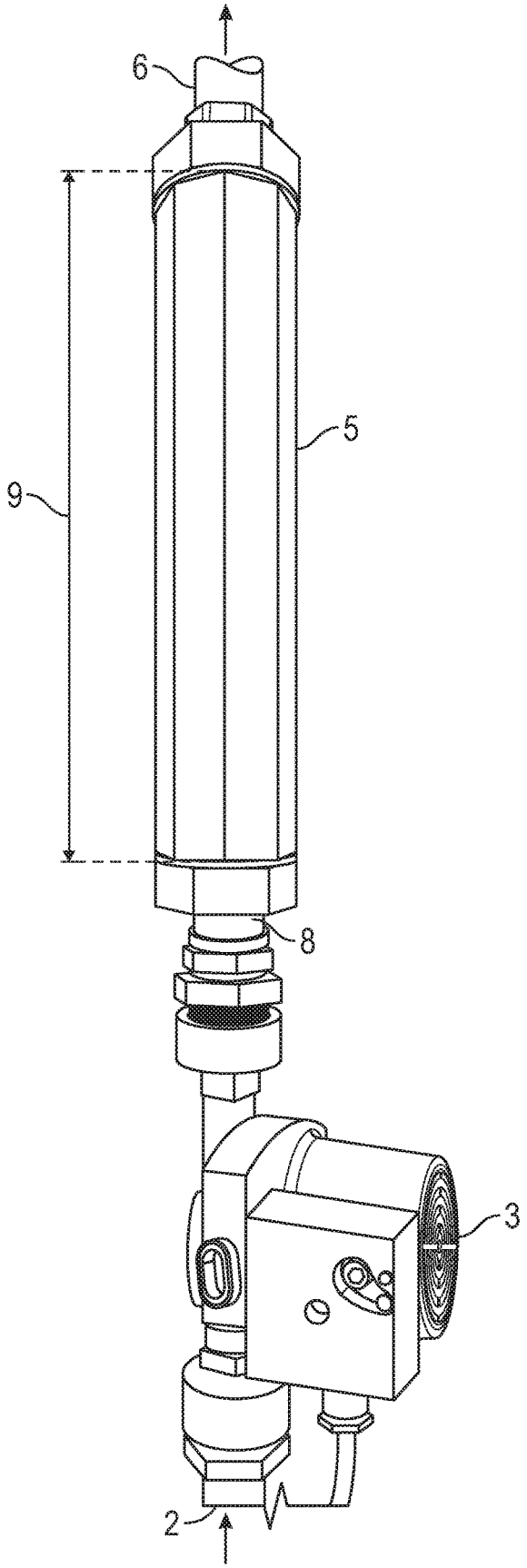
FIG. 3, is a perspective view illustrating an embodiment of a circulating pump and magnetic device.

Referring to FIG. 3, there is shown on the filler material transfer vessel (see FIG. 2) a close-up view of a pumping or circulating device (3), located just prior to the magnetic device (5) and the treatment zone (9). Although the pumping or circulating device (3) is shown prior to the magnetic device (5) in this view, the pumping or circulating device (3) can be located after the magnetic device (5) or anywhere in-between the inlet (2) and outlet (6) as shown in FIG. 2.

Figure 4:
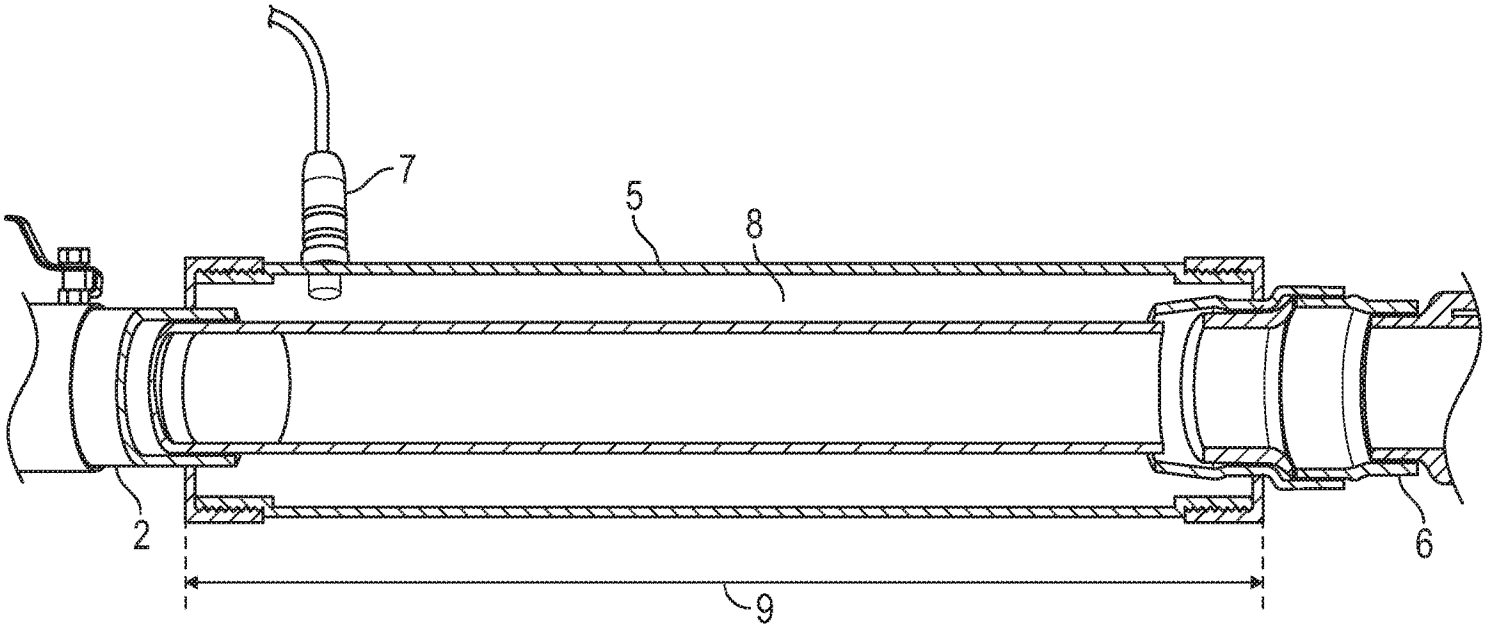
FIG. 4, a cross-sectional diagram of the magnetic device.
Figure 4A:
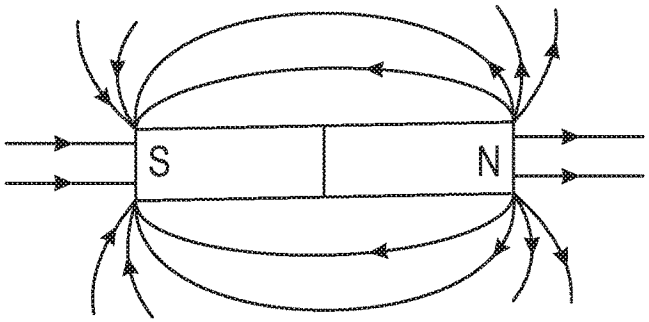
FIG. 4*a*, is a simplified view of the magnetic force or the magnetic field that is found around a typical magnetic device.

Referring to FIG. 4, a cross-sectional view of the magnetic device (5) is shown. A filler material and/or a cellulosic furnish is introduced within the treatment zone (9) of the magnetic device (5) through a pipe or conduit (8) and an electromagnetic force or charge is produced by the magnetic device and applied to the filler material as it passes through the treatment zone (9). If the filler material is introduced to the treatment zone (9) with no cellulosic furnish, the filler material after treatment is combined with a cellulosic furnish and a paper, paperboard, or cardboard product is produced having improved filler retention when compared with a paper product in which an electromagnetic force was not applied to the filler and/or cellulosic furnish. FIG. 4*a*, provides a simplified view of a magnetic device and the magnetic fields associated with it. As depicted, the field is strongest at its poles, which are at the ends of the magnet signified by a North (N) pole and a South (S) pole. The field around a magnet is represented by the lines and arrows representing the direction of the magnetic force on the north pole. The closer together the lines are, the stronger the field. The magnetic field in the examples below, were generated using a power control unit that generated a flow of electrical current, thus creating the magnetic field necessary to change the surface charge on the filler material.

In some aspects of the current process, the filler material can be selected from fillers, such as, $TiO_2$, ZnO, $CaCO_3$, precipitated $CaCO_3$, talc, gypsum and combinations thereof. In some preferred aspects of the process, the filler material is $TiO_2$.

In some aspects of the current process, the final product has an ash content of from about 1 wt. % to about 30 wt. % and can be from about 2 wt. % to about 10 wt. %. Ash content being determined by various means, for example, by the Smithers Pira method on oven dried samples, which are heated to 525° C. (or 900° C.) to ensure that all the combustible cellulose material is consumed. This leaves only the inorganic fraction of the material measured as the ash content, which is express as a percentage (%) of the original oven dried weight. From this the amount of filler retained in the sheet can be calculated.

In some aspect of the current process, the filler is subjected to an EMF and added to the wet end of a papermaking process, for example at the headbox, centrifugal cleaners, mixing tank or vessel, machine tank, machine refiners, and/or the equalizing chamber or combinations thereof.

In yet other aspects of the process, the method provides for improving filler and fiber bonding in a papermaking process wherein a cellulosic furnish is provided and combined with one or more filler materials, and forming a paper, paperboard or cardboard product. An electromagnetic force (EMF) of about 0.1 tesla (T) or higher, can be about 1 tesla or higher, and may be 5 tesla or higher can be applied to the filler material within a treatment zone of the magnetic device. In preferred embodiments, the EMF is from about 0.02 tesla to about 0.40 tesla and is applied to the filler material for an amount of time sufficient to change the surface charge of the filler material. Depending on the filler material, an electromagnetic force or charge can be applied to the filler material for from about 5 minutes to 4 hours and can be from about 15 minutes to 2 hours, and may be for about 15 minutes to about 60 minutes. The amount of time and EMF is largely dependent upon the type of filler material being treated and added to the cellulosic furnish.

In some aspects of the process, the step of applying the electromagnetic force includes providing an electrical charge to the magnetic device to generate the electromagnetic force within a treatment zone and positioning the one or more filler materials and/or the cellulosic furnish within the treatment zone.

In some aspects of the process, the EMF is applied to the filler material prior to the filler material being added to the cellulosic furnish. However, it is envisioned that the filler material could be combined with the cellulosic furnish and an EMF applied to the combined mixture.

In other aspects of the device, the electromagnetic force is controlled by an electromagnetic control device capable of changing the strength of the electromagnetic force. Depending upon the filler material, it may have to be subjected to the EMF of varying strength.

In some aspects of the device, the filler material is $TiO_2$, ZnO, $CaCO_2$, precipitated $CaCO_3$, talc, gypsum, and combinations thereof. Preferably the filler material is $TiO_2$.

In yet other aspects of the device, the device is capable of delivering the treated filler material to a paper machine, paperboard or cardboard making process.

In yet other aspects, a device for improving filler retention in a papermaking process is provided for. The device includes a vessel having a vessel inlet and a vessel outlet spaced from the vessel inlet, the vessel defining a chamber between the vessel inlet and the vessel outlet, and the vessel inlet configured to receive a filler material. The device further includes a magnetic device disposed within the chamber, and the magnetic device is capable of generating an electromagnetic force within the chamber. The device is configured to apply an electromagnetic force on the filler material as the filler material moves through the chamber thus improving filler retention of the filler material when forming a paper, paperboard, or cardboard product.

In some aspects the magnetic device includes a power control unit in which the strength of the electromagnetic force can be adjusted.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

EXAMPLES

The embodiments of the invention are defined in the following Example. It should be understood that the Example is given by way of illustration only. Thus, various modifications of the present invention in addition to those shown and described herein will be apparent to those skilled in the art from the foregoing description.

In the following examples, a device similar to that depicted in FIG. 2, was used to facilitate the treatment and transfer of a filler material to a cellulosic furnish and forming of a paper sheet. The filler material was placed into the filler material transfer vessel (1) through an opening (2) at the top of the transfer vessel (1) and the opening closed. The filler material was circulated through a closed loop system including the transfer vessel (1), a circulating device (3), a magnetic device (5) and a return pipe or conduit (4) to the transfer vessel (1). The magnetic device (5) was disposed between the circulation device (3) and return conduit or pipe (4) including a treatment zone (9) in which an electromagnetic force or charge was applied to the filler material. The filler material was recirculated through the closed-loop system (1), (3), (4) and (5), for a desired amount of time and then combined with a cellulosic furnish and a paper sheet was formed. Various testing was done as described below.

Example 1

A 10 wt. % slurry of either $TiO_2$ or precipitated calcium carbonate (PCC) filler was placed in a filler transfer vessel (1) and circulated through the closed-loop system (1), (3), (4) and (5) as described above. An electromagnetic force (EMF) of between about 0.020 tesla (T) and 0.400 T was applied to the filler material in the treatment zone (9) for 0 minutes, 15 minutes, 60 minutes 120 minutes and 4 hours. The applied EMF to the samples was determined by the number of circulations through the treatment zone (9). Paper sheets were made as described below in which a reference sample, i.e. no electromagnetic force was applied to the filler material, was compared with paper sheets made using the filler material treated with an electromagnetic force.

After the slurry was subjected to the magnetic field, the slurry was added to a mixing vessel containing cellulose fibers. To this mixture was added 0.25 wt. % starch and the mixture sent to the headbox of the trial paper machine located at the Solenis LLC facility, Wilmington, Del., and a sheet produced having comparable filler levels, grammage, and thickness properties.

Table 1, shows the sheet properties of the produced sheets. The sheets were analyzed for the following using procedures outlined by the International Organization for Standard (ISO): ash content was determined using the following procedures: Ash 500 ISO 1762 and Ash 900 ISO 2144 and SCAN P5:63; opacity was analyzed using procedure ISO 2471-1; specific filler content was determined with an ACA—Ash Content Analyzer, Emtec Innovative Testing Solutions; sheet brightness was determined using ISO 2470-1; grammage was determined using ISO 53; and sheet thickness was determined using ISO 534.

TABLE 1

| Filler Material | | $TiO_2$ | | | | | PCC | | |
|---|---|---|---|---|---|---|---|---|---|
| Sample No. | | 1 | 2 | 3 | 4 | 6 | 7 | 8 | 9 |
| Paper Analysis | charge time | 0 | 0 | 60 minutes | 120 minutes | 4 hours | 0 | 15 minutes | 60 minutes |
| Targeted Filler Level in Sheet | % | 0 | 12 | 12 | 12 | 12 | 12 | 12 | 12 |
| Grammage | $g/m^2$ | 28.7 | 28.1 | 27.9 | 28.3 | 28.4 | 27.6 | 27.7 | 28.4 |
| Thickness ×10 | μm | 41.2 | 39.0 | 39.4 | 39.8 | 40.2 | 41.1 | 40.3 | 42.4 |
| Brightness C hp | % | 83.8 | 89.1 | 89.4 | 89.5 | 89.5 | 88.0 | 88.2 | 88.2 |
| Opas. Tappi | % | 38.1 | 68.2 | 69.4 | 69.4 | 68.9 | 60.6 | 60.7 | 62.8 |

The sheets were produced on the paper trial machine and sheets made with $TiO_2$ and PCC, both before and after an EMF had been applied to the filler material as outline in Table 1. Results indicate that when an EMF is applied to the filler material for as little as 15 minutes with the PCC can help improve the brightness and opacity of a filled paper product.

TABLE 2

| | Number<br>% | 2<br>100 | 3<br>100 | 4<br>100 | 6<br>100 |
|---|---|---|---|---|---|
| $TiO_2$ | | | | | |
| $TiO_2$ | charge time | 0 | 1 h | 2 h | 4 h |
| Ash 500° C. | % | 11.29 | 12.00 | 11.73 | 11.87 |
| Ash 925° C. | % | 11.20 | 11.92 | 11.64 | 11.85 |
| ACA measurements | | | | | |
| Total filler ACA | % | 11.0 | 11.1 | 11.3 | 11.1 |
| TiO2 ACA | % | 10.2 | 10.4 | 10.6 | 10.4 |

An electromagnetic force was applied to the filler materials for zero minutes, 1 hour, 2 hours and 4 hours prior to being combined with the cellulosic furnish and a paper sheet made. It can be clearly seen using two different types of measurements, that there was an improvement in filler retention level based on ash measurements and ACA measurements for the filler materials where an EMF was applied to change the surface charge on the $TiO_2$.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A process for the production of paper, paperboard, or cardboard comprising:

providing a cellulosic furnish;

applying an electromagnetic force to one or more filler materials sufficient to change the surface charge of the filler material to produce one or more treated filler materials and optionally to the cellulosic furnish;

combining the cellulosic furnish with the one or more treated filler materials; and forming a paper, paperboard or cardboard product from the filler material and cellulosic furnish.

2. The process according to claim 1, wherein the step of applying the electromagnetic force comprises:

providing an electrical charge to a magnetic device to generate the electromagnetic force within a treatment zone; and positioning the one or more filler materials and optionally the cellulosic furnish within the treatment zone.

3. The process according to claim 2, wherein the magnetic device is disposed within a transfer vessel, and wherein the magnetic device is configured to apply an electromagnetic force sufficient to change the surface charge of the filler material as the filler material is positioned within the treatment zone.

4. The process according to claim 1, wherein the electromagnetic force is 0.040 tesla or higher.

5. The process according to claim 4, wherein the electromagnetic force is 0.20 tesla or higher.

6. The process according to claim 1, wherein the filler is positioned in the treatment zone for at least 15 minutes.

7. The process according to claim 6, wherein the filler material is positioned within the treatment zone for at least 60 minutes.

8. The process according to claim 1, wherein the filler material is positioned within the treatment zone for at least 15 minutes, and the electromagnetic force is between 0.020 tesla and 0.40 tesla.

9. The process according to claim 1, wherein the one or more filler materials is selected from the group of $TiO_2$, ZnO, $CaCO_3$, precipitated $CaCO_3$, talc, gypsum and combinations thereof.

10. The process according to claim 1, wherein the one or more filler materials is $TiO_2$.

11. A cellulosic product produced by the process according to claim 1.

12. The cellulosic product of claim 11, wherein the cellulosic product formed from the filler material after application of the electromagnetic force exhibits an improved filler retention as compared to a cellulosic product formed from a filler material free from application of the electromagnetic force.

13. The cellulosic product of claim 11, wherein the cellulosic product formed from the filler material after application of the electromagnetic force exhibits an improved brightness in accordance with ISO 2470-1 as compared to a cellulosic product formed from a filler material free from application of the electromagnetic force.

14. The cellulosic product of claim 11, wherein the cellulosic product formed from the filler material after application of the electromagnetic force exhibits an improved opacity in accordance with ISO 2471-1 as compared to a cellulosic product formed from a filler material free from application of the electromagnetic force.

* * * * *